US007422196B2

(12) United States Patent
Binetti Pozzi et al.

(10) Patent No.: US 7,422,196 B2
(45) Date of Patent: Sep. 9, 2008

(54) DRIVE SYSTEM FOR ACTIVATING/DEACTIVATING MOTION TRANSMISSION IN SAILING BOATS

(75) Inventors: Francesco Binetti Pozzi, Verbania (IT); Andrea Merello, Genoa (IT)

(73) Assignee: Harken Italy S.p.A. (IT)

( * ) Notice: Subject to any disclaimer, the term of this patent is extended or adjusted under 35 U.S.C. 154(b) by 388 days.

(21) Appl. No.: 11/145,114

(22) Filed: Jun. 3, 2005

(65) Prior Publication Data

US 2006/0169963 A1 Aug. 3, 2006

(30) Foreign Application Priority Data

Jun. 15, 2004 (IT) ..... MI2004A1197

(51) Int. Cl.
*B66D 1/14* (2006.01)

(52) U.S. Cl. ..... 254/349; 254/367

(58) Field of Classification Search ..... 254/294, 254/299, 303, 315, 317, 349, 367; 474/62, 474/68, 156

See application file for complete search history.

(56) References Cited

U.S. PATENT DOCUMENTS 3,641,877 A * 2/1972 Herbert ..... 91/44
4,646,870 A 3/1987 Koch et al.
4,646,894 A 3/1987 Kamio
5,540,292 A * 7/1996 Behrens ..... 173/184
6,534,958 B1 * 3/2003 Graber et al. ..... 322/11
7,086,841 B2 * 8/2006 Cornwell ..... 417/290
2002/0098930 A1 * 7/2002 Merello et al. ..... 474/62

* cited by examiner

*Primary Examiner*—Emmanuel M Marcelo
(74) *Attorney, Agent, or Firm*—Pyle & Piontek, LLC

(57) ABSTRACT

The invention refers to a drive system of the servo-pneumatic type for activating/deactivating motion transmissions in sailing boats. The drive system of the invention is adapted to activate/deactivate motion transmission operating configurations, or for shifting from one motion transmission operating configuration to another one, when a drive is given by a crew member, much more rapidly than with the mechanical drive systems known in the art. The drive system of the invention can be used, for example, for activating/deactivating the motion transmission between pedestals and/or between pedestals and winches, or for driving the shift from one winch speed to another one, or to prevent the deactivation of a first winch speed when shifting from a first speed to a second speed, or also for driving any speed multiplier connected to the winches.

16 Claims, 3 Drawing Sheets

DRIVE SYSTEM FOR ACTIVATING/DEACTIVATING MOTION TRANSMISSION IN SAILING BOATS

The present invention refers to a drive system for activating/deactivating motion transmission in sailing boats.

The invention also refers to a motion transmission system in sailing boats comprising the drive system of the present invention.

The drive system for sailing boats and the motion transmission system of the present invention find a preferred application, though not the only, in medium-large sized racing sailing boats, such as for example America's Cup yachts, which compete in races where the crews have to arrange new configurations on board the boat, whenever the wind circumstances change, in the shortest possible time and with the most perfect synchronisation among the various crew members, in order to continue racing under the best possible conditions for success in the competition.

As is already known, the medium-large sized boats referred to in the present invention comprise conventional elements adapted to set new particular sail configurations during races. Well known examples of such elements are "winches" and pedestals, used on sailing boats to facilitate the manoeuvring and trimming of sails carrying a load, such as for example the manoeuvres for positioning and hoisting the sails. Said manoeuvres are carried out by manoeuvring suitable ropes (commonly referred to also with the terms: sheets or halyard) suitably connected to the sails; the ropes, in particular, are pulled by winding the same on proper winches suitably arranged on the deck of the boat.

The traction is applied to the rope by imparting a rotation to a kinematic element, such as for example the primary shaft of the winch which transfers, by means of friction, a pulling force to the ropes which are partly wound onto the winch drum. Such rotation may be imparted by one or more crew members through different transmission systems which are alternative to each other.

There is also provided the use of a drive pedestal equipped with handles, located onto the deck of the boat at a remote position with respect to the winch, and of a series of components and accessories adapted to transmit the motion from the pedestal to the winch. These comprise, for example, a first kinematic device, such as a driving pulley housed at an upper end of the pedestal, a second kinematic device such as a driven pulley housed at a lower end of the pedestal and a kinematic connection device such as a transmission belt between the driving pulley and the driven pulley. The driven pulley can be keyed onto a spindle or a clutch for mechanical linkage to one end of a shaft for motion transmission to the winch; the other end of such shaft is instead intended to be connected through a second clutch or joint with a 90° conical gear housed within a suitable box located below the winch and adapted to transmit the motion to the primary shaft thereof. The rotation of the driving pulley, and consequently of the winch, is driven by one or more crew members turning suitable handles mounted at the upper end of the pedestal coaxially with the driving pulley.

Such transmission system is typically used for trimming medium-large sized racing sailing boats, where it is necessary to guarantee speed and power of execution. In fact, according to such system, one or more crew members may operate the winch while being in a standing position, such position being more comfortable and allowing more power to be provided.

Typically the racing sailing boats, such as, for example, America's Cup yachts, are fitted with a number of winches, some of them being driven by drive pedestals equipped with handles (in particular, the two primary winches, the two secondary winches and the winches for the movable shrouds and for the gaff-sail sheet). The deck layout of these boats is designed in such a way that the winches which are to face with particularly high loads (such as, for example, the primary winches under strong wind conditions) can be operated by more than one crew member at once. In such a case, such winches are driven by means of a number of drive pedestals equipped with handles (typically, two or three pedestals, but theoretically there could even be more) kinematically linked together in order to synchronise the motions driven to the winches from each of them: in this way it is possible to considerably increase the force transmitted by the crew members to the winch and, accordingly, the fraction exerted by the winch on the rope.

The kinematic connection between the various pedestals can be arranged, for example, in the typical configuration with two pedestals side by side, both operating the same winch through a single motion transmission shaft kinematically linked to the clutches of the two pedestals; or, in the typical configuration with three pedestals (two of them side by side and one in a longitudinal position), through a central multiple-input gearbox kinematically linked to the three motion transmission shafts outputting from the three pedestals.

Typically, racing boat deck layout is also designed to give these boats the characteristics of versatility and adaptability to the particular racing weather and navigation conditions expected from time to time. With this in mind, the clutch of the drive pedestals currently used in racing sailing boats is generally fitted with an engage/disengage mechanism (preferably arranged on both sides of the pedestal) enabling the crew members to activate/deactivate the kinematic connection between the individual pedestals and the winches and/or between two pedestals.

In essence, due to the use of pedestals with such engage/disengage mechanisms, it is possible to select a plurality of operating configurations of kinematic connections between pedestals and winches, for the same deck layout of a boat: at any given time, that configuration which, in view of the specific weather and navigation conditions, ensures the maximum speed and powerful execution in sail setting and adjusting manoeuvres is chosen. It is, for example, possible to shift from a configuration where only one pedestal is operating on each primary winch (a typical configuration under light wind conditions) to a configuration wherein two or three pedestals are operating on said winches (a typical configuration under strong wind conditions); it is also possible to decide to kinematically disconnect, for other reasons, a winch from a pedestal, etc.

From the building point of view, the pedestal clutch featuring an engage/disengage mechanism generally consists of a first kinematic device, for example a first splined spindle (the clutch's input), to which is coaxially lined up a second kinematic device, for example a second splined spindle (the clutch's output), onto which a kinematic connection device between said first and second kinematic devices, for example an internally-splined sleeve, is slidely mounted; said second splined spindle is in turn connected by means of another sleeve or joint to the shaft providing motion transmission to the winch or to the shaft which kinematically connects to the other pedestals. The sleeve, by means of a foot drive or a lever, slides back and forth between a first position, wherein it engages with the ends of both the first and second splined spindles in order to kinematically connect them, and a second position wherein it sits entirely on the second splined spindle in order to kinematically disconnect it from the first splined spindle.

Shifting from one configuration to the other one should be almost instantaneous, minimising any delay before the new configuration can be used. This change of configuration is generally driven by the crew members by pushing on suitable devices, such as, for example, pedals or push-buttons, usually arranged on the deck of the boat on either side of the pedestal and mechanical connected to the previously cited engage/disengage systems.

In practice, unfortunately, there are certain drawbacks to this solution wherein a new configuration is brought into play by means of mechanical drive systems. For example, the change of configuration often is not activated until a crew member has fully and for a while depressed the pedal. The fact that the change of configuration cannot be quickly obtained is a particularly acute problem in racing sailing boats. Indeed, it is recognised that the crews of medium-large sized boats to which the present invention is referred to, such as for example yachts competing in the America's Cup race, have the need to realize new operating configurations on boat board, as required by new wind conditions, in the shortest possible time and with the best possible synchronisation among the crew members, to continue racing under the best possible conditions for success in the competition. Every single delay due to a poorly-executed manoeuvre can be a determining factor in the continuation of the race. The problem is of course aggravated by the awkward conditions under which the crew members operate during a race.

Another problem connected with the previously described mechanical systems for activating a new operating configuration arises from imperfect clutch due to the low precision and to the unavoidable unevenness of the actuating force, in that the pressure exercised by the crew member on the pedal which activates the change of configuration varies from time to time, and, even changes during one individual push. The lack of promptness in the activation of the change of configuration, and the difficulty of coordination between the crew member operating the pedal and the other crew members, can accordingly cause the boat to be suddenly unstable, and all the crew members must suddenly face with this unstable condition to restore optimal operating configurations throughout the race.

In the known technical solutions involving the use of mechanical systems for activating new operating configurations, these problems all cause delayed and imperfect execution of certain sail-setting manoeuvres during the race, which adversely affect the results of the race itself.

The same problems previously described are also to be found in the solutions involving the use of mechanical systems to obtain winch speed changes. Multi-speed winches (or "multi-gear winches": the two terms being interchangeably used), allowing to change the ratio between the rotation speed of first kinematic devices, such as, for example, the motion devices associated to the winch input shaft, and the rotation speed of the second kinematic devices, such as, for example, the winch drum, onto which the ropes are partly wound, are known for long time and are widely used. By this way, it possible to use a higher gear (or a high speed) for a rapid winding-in of the rope in the presence of a light pulling force, or and a lower gear (or a low speed) for applying stronger traction when adjusting a sail under load. Two-speed winches are normally designed so that a first ratio applies when the input shaft is being turned one way, and the second ratio applies when it is being turned the other way. The change of ratio is in that case obtained simply by changing the turning direction of the input shaft. Existing technology also includes three-speed winches with three ratios available, respectively high, medium and low, and winches with more than three speeds such as, for example, described in U.S. Pat. No. 4,667,934.

The same problems as described above also occur in the solutions involving the use of mechanical systems to lock a first winch speed when shifting from first to second speed by changing the turning direction of the winch main shaft, in such a way that the first speed is re-engaged when the turning direction is changed again (in three-speed winches lacking this locking system, a second change in the turning direction of the winch main shaft would in fact produce a shift from second to third speed), or in solutions involving the use of mechanical systems for activating/deactivating any speed multiplier associated to the winches.

The first aspect of this invention accordingly relates to a drive system for activating/deactivating motion transmissions in sailing boats, characterised by the fact that such drive system is a servo-pneumatic one. Such drive system allows to have a constant activating/deactivating force, a faster activation and consequently an overall improvement in the quality of the activation/deactivation of motion transmissions in sailing boats, compared with the mechanical drive systems so far known in the art.

Another advantage connected to the drive system of the present invention consists in the possibility to locate anywhere on board the boat the pedal or push-button used to operate such drive system, free from the constraints involved in mechanical type transmission, where connecting rods or ropes and their transmissions limit the pedal or push-button to particular locations in the deck layout.

Preferably, the drive system of the present invention comprises a compressed air reservoir, at least one pneumatic actuator (preferably a pneumatic cylinder), a pneumatic circuit for the flow of compressed air, at constant pressure, from such reservoir to such at least one pneumatic actuator, an on/off switch that can be actuated by at least one crew member of the sailing boat to drive the flow of compressed air within such circuit and a pneumatic valve activated by such switch, located between such compressed air reservoir and such at least one pneumatic actuator. Advantageously, the compressed air has always the same pressure and flow rate and, consequently, the activation/deactivation force is constant. The possibility to act with compressed air at constant pressure facilitates manoeuvres relating to the motion transmission between pedestals and/or between pedestals and winches and/or in speed changes actuated by the drive system of the present invention.

The compressed air reservoir of the drive system of the present invention can be a reservoir installed for this particular purpose or, preferably, a reservoir already present on board of boats, such as that used in medium-large sized sailing boats for driving the seal pressure system for the port-holes.

The pneumatic circuit of the drive system of the present invention is preferably fitted with compressed air flow drive systems of conventional type, such as, for example, pressure gauges, flow meters, valves and similar components.

The on/off switch can be located, for example, near the base of one of the pedestals whose, handles are operated by the crew members of the boat. In accordance with the invention, the switch is operated by means of a quick and light push on the switch itself by the foot of one of the crew members operating such pedestals, unlike the case of the mechanical drive systems known in the art, where a sustained pressure is often necessary to activate the drive system. The switch has two positions, closed and open; in the resting position, wherein the on/off switch is closed, the pneumatic valve is also closed and consequently there is no flow of compressed air in the pneumatic circuit. The above-mentioned quick and light push on the switch by the foot of one of the crew members causes the shift of the switch from the closed position to the open one, or vice versa. Such shift in the switch position can for example cause the actuation of a sliding wedge connected to the lower portion of the switch itself, which then presses on a plunger in the pneumatic valve which opens an aperture and lets through compressed air at constant pressure in the pneumatic circuit, from the reservoir to at least one of the pneumatic actuators.

In a preferred embodiment of the invention, the switch is located in an area remote from any of the pedestals equipped with handles operated by the crew members of the boat; in such a case, the switch is operated, for example, by a crew member other than those who operate the pedestal handles. In a further preferred aspect of the invention, the switch can be located on the pedestal handles themselves, or can even be operated by an electrical signal or by a signal sent via radio, regardless of where the switch itself is located.

In accordance with a preferred aspect of the present invention, the drive system comprises one pressure reducer located, in the pneumatic circuit, between such compressed air reservoir and such at least a pneumatic actuator, to reduce the original pressure of the compressed air delivered by the reservoir (e.g. 200 bar) to a lower one (e.g. 5 bar), suitable for driving the pneumatic actuator.

Preferably, the drive system of the present invention also comprises one or more distributors adapted to homogeneously and uniformly direct the compressed air to several pneumatic actuators.

In a second aspect, the present invention relates to a motion transmission system for sailing boats, comprising first kinematic driving means, second kinematic driven means and kinematic connecting means between said first and second kinematic means, said kinematic connecting means being selectively deactivable to define a first operating configuration of kinematic connection between said first and second kinematic means in such a way not to allow any motion transmission from said first and second kinematic means, and at least a second operating configuration of kinematic connection between said first and second kinematic means in such a way to allow a motion transmission from said first and second kinematic means, characterized by the fact that said kinematic connecting means are adapted to be driven by means of a drive system of the type described above.

Such a transmission system presents all the advantageous characteristics illustrated above, with reference to the drive system of the present invention.

Preferably, such transmission system is adapted to activate/deactivate the kinematic connection between pedestals, or between pedestals and winches or also to realize a new winch operating configuration corresponding to a specific rotation speed of the winches, by deactivating at the same time an earlier operating configuration corresponding to a different rotation speed of the winches, or in addition to activate in a winch a kinematic connection adapted to realize a new operating configuration corresponding to a specific rotation speed of the winches, without deactivating at the same time an earlier operating configuration corresponding to a different rotation speed; or also to activate a winch speed multiplier.

In general, such a transmission system can be used in a sailing boat in any situation wherein is desired to activate/deactivate the operating configurations of motion transmission or to shift from an operating configuration of motion transmission to another one, upon a drive given by a crew member.

Further characteristics and advantages of the present invention will be made clearer by the following detailed description of one its preferred embodiment, with reference to the attached drawings. In these, drawings, FIG. 1 represents a schematic view of part of a deck of a sailing boat where a preferred embodiment of a drive system according to the present invention is installed;

Figure 1:
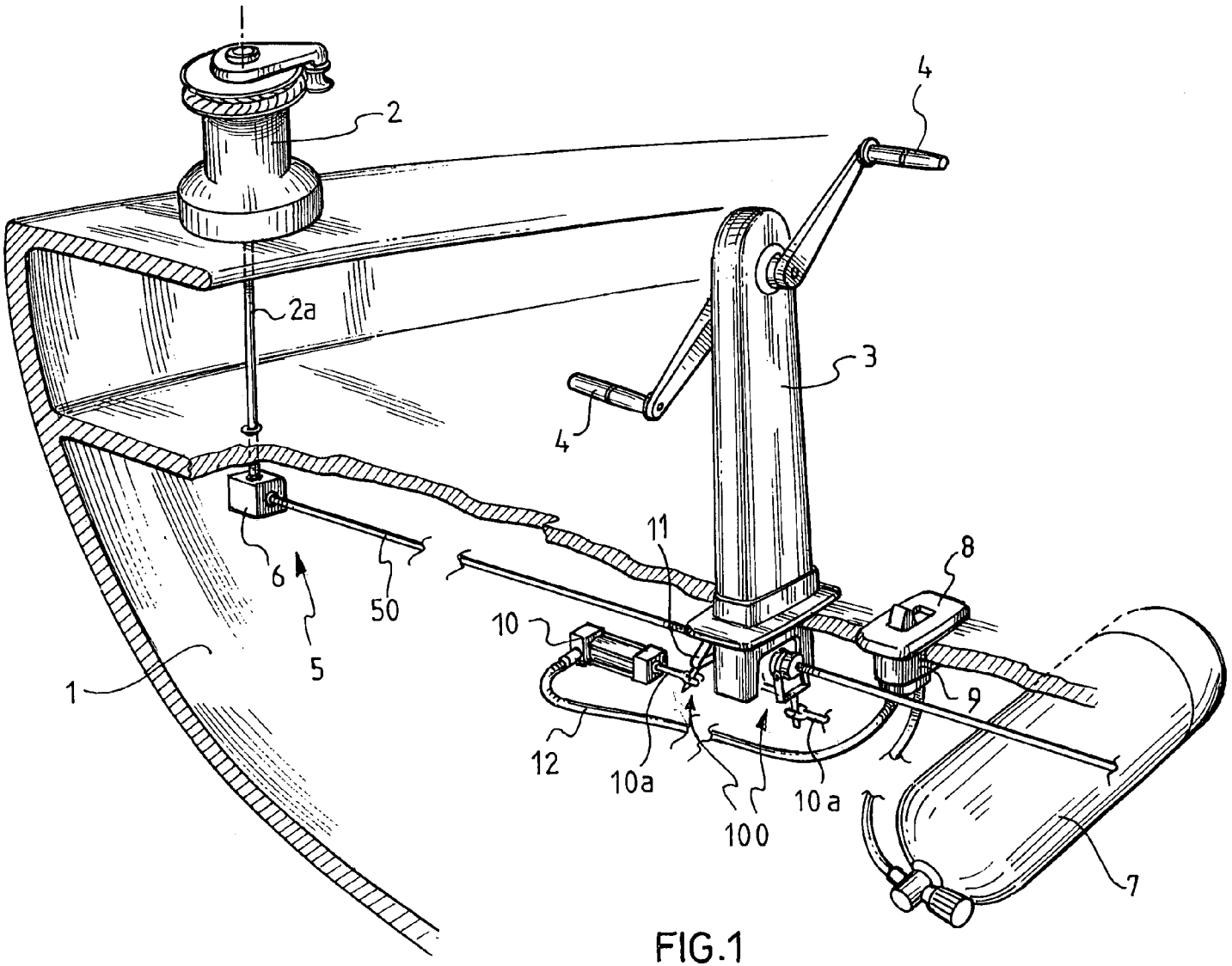

One preferred embodiment of the present invention is shown in FIG. 1, which illustrates, among other things, conventional elements generally present on a medium-large sized sailing boat 1, such as, for example, a winch 2 and a pedestal 3 for operating the winch 2, such pedestal 3 being equipped with handles 4 manually operated by at least one crew member of the sailing boat. It also shows a mechanical transmission, the whole of which is marked 5, comprising a motion transmission shaft 50 and a 90° conical gear 6. The conical gear 6 is housed within a suitable box located underneath the winch and is adapted to transmit to the main shalt 2*a* of the winch 2 the rotary motion given by the crew members to the handles 4 of the pedestal 3 and transmitted via the motion transmission shaft 50.

Still with reference to FIG. 1, a preferred embodiment of the drive system of the present invention adapted to drive a conventional disengagement/engagement system 100 can be seen at the base of the pedestal 3. Such disengagement/engagement (or clutch) system 100 typically comprises a first splined spindle 51 (the clutch input) connected to the pulley (not shown) at the base of the pedestal 3, to which a second splined spindle 52 (the clutch output), on which is mounted an internally-splined spindle sliding sleeve 53, is coaxially lined up; the second splined spindle 52 is then connected by means of another sleeve or joint (not shown) to the shaft 50 for the motion transmission to the winch.

The sleeve 53 can move between one position, wherein it engages with the ends of both the first and second splined spindles 51 and 52 so as to kinematically link them, and a second position wherein it sits entirely on the second splined spindle 52 thus to kinematically disconnect it from the first splined spindle 51.

In the embodiment of the drive system of the present invention illustrated in the attached drawings, such drive system comprises a compressed air reservoir 7, an on/off switch 8 located near the base of the pedestal 3, a pneumatic valve 9 connected to the on/off switch 8, a pneumatic circuit 12 and a pneumatic cylinder 10 which receives compressed air delivered from the reservoir 7 when the pneumatic valve 9 is actuated by the on/off switch 8. The pneumatic cylinder 10 comprises a piston 10*a* connected to the fork 11 of the disengagement/engagement system 10 of the pedestal 3.

Figure 2:
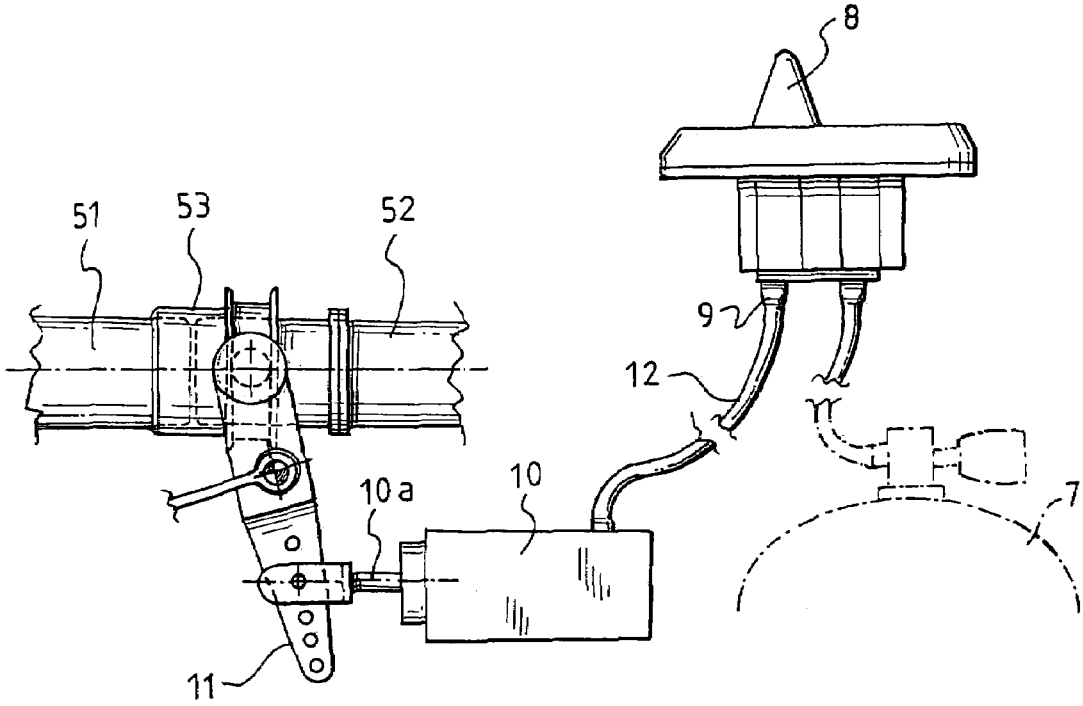
FIG. 2 represents a section, view of the preferred embodiment of the drive system according to the present invention shown in FIG. 1, in its first operating configuration.

FIG. 2 shows a first operating configuration of the servo-pneumatic drive and motion transmission system of the present invention, wherein the on/off switch 8 is in the closed position, the pneumatic valve 9, operated by such on/off switch 8, also being consequently closed, and there is therefore no flow of compressed air within the pneumatic circuit 12 which connects the compressed air reservoir 7 to the pneumatic cylinder 10. The fork 11 is consequently in its first operating position which, in the specific example shown in FIGS. 2 and 3, corresponds to an operating configuration wherein the sleeve 53 kinematically connects the first splined spindle 51 and the second splined spindle 52.

Figure 3:
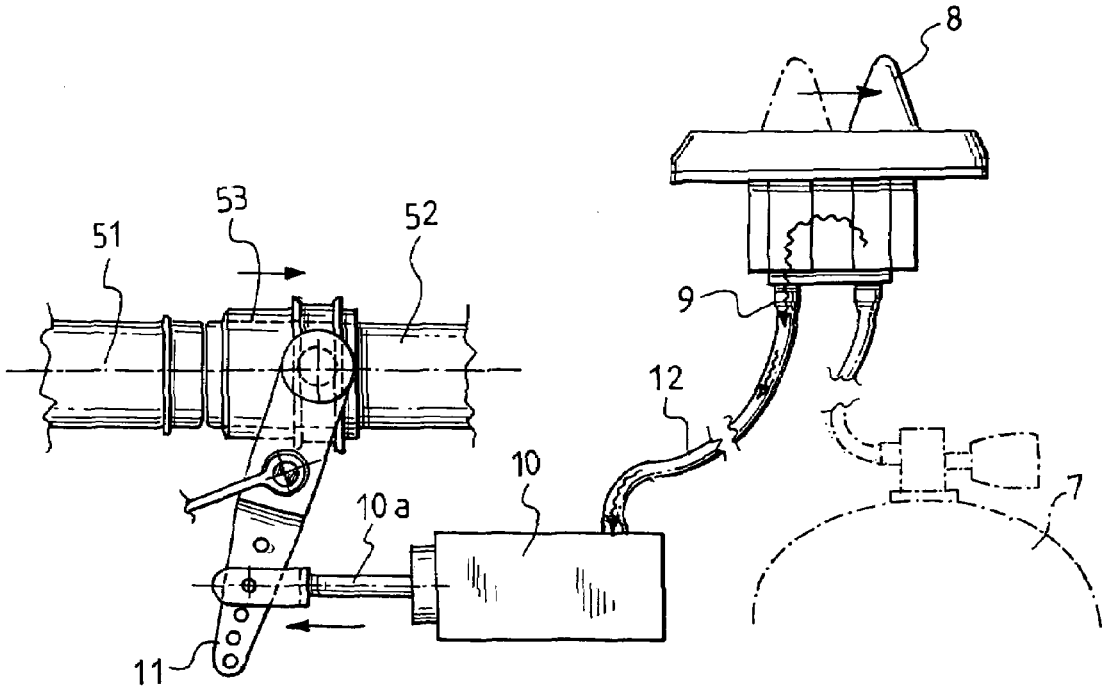
FIG. 3 represents a section view of the preferred embodiment of the drive system according to the present invention shown in FIG. 1, in its second operating configuration.

FIG. 3 shows a second operating configuration of the servo-pneumatic drive and motion transmission system of the present invention, wherein the on/off switch 8 is this time in the open position, the pneumatic valve 9, operated by such on/off switch 8, also being consequently in the open position, and a flow of compressed air is consequently generated, at constant pressure, within the pneumatic circuit 12 connecting the compressed air reservoir 7 to the piston 10*a* of the pneumatic cylinder 10. The piston 10*a*, receiving compressed air at constant pressure, moves the fork 11 which shifts the sleeve 53 on the second splined spindle 52 so as to kinematically disconnect the first splined spindles 51 and the second splined spindles 52.

In an entirely similar manner to that described above in relation to the disengagement/engagement (or clutch) system 100 located at the base of the pedestal 3, the drive system of the present invention can be; applied to any motion transmission systems on sailing boats and adapted to activate/deactivate operating configurations of motion transmission or to shift from one operating configuration of motion transmission to another one, upon a drive given by a crew member. For example, the drive system of the present invention can be applied in conventional multi-speed winches for actuating the shift from one speed to another one. Furthermore, the drive system of the present invention can also be applied in conventional multi-speed winches equipped with mechanical locking systems to prevent the deactivation of a first speed when shifting from the first to a second speed, and also in solutions involving the use of mechanical systems for activating/deactivating any speed multiplier connected to the winches.

Figure 4:
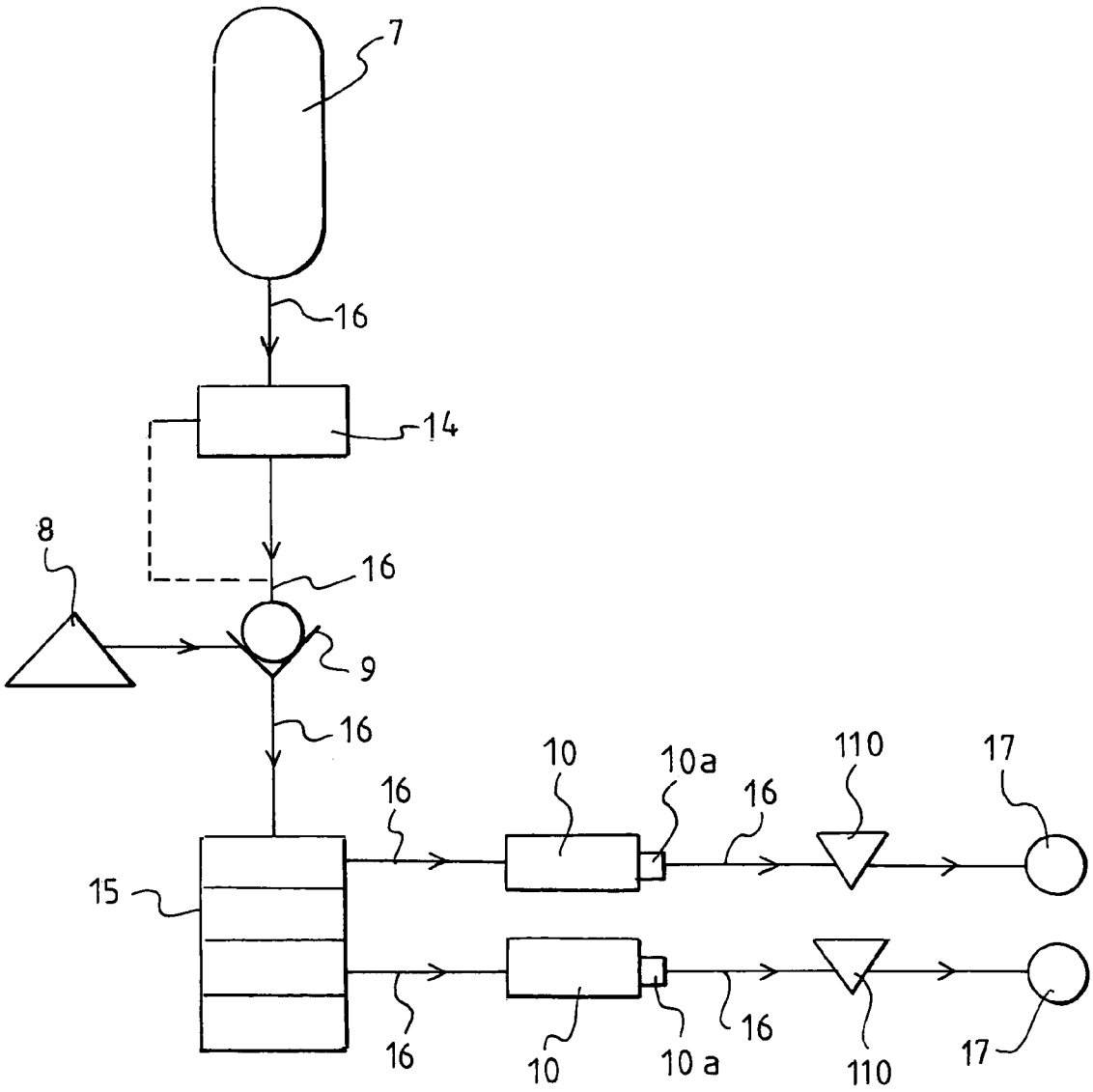
FIG. 4 represents a flowchart of one preferred embodiment of the drive system of the present invention.

In FIG. 4 is also schematically shown a preferred embodiment of the drive system of the present invention, wherein the compressed air reservoir 7, a pressure reducer 14 adapted to reduce the pressure of the compressed air delivered by the reservoir 7, the on/off switch 8 which activates the pneumatic valve 9 and a compressed air distributor 15 adapted to homogeneously and uniformly distribute the compressed air to one or more pneumatic cylinders 10 are visible, each of these pneumatic cylinders 10 being in turn connected to a kinematic connecting element 110 (corresponding to the group consisting of the fork 11 and the sleeve 53 of the example illustrated in FIGS. 2 and 3), which in turn is connected to a system 17 for motion transmission between pedestals or between pedestals and winches and/or for changing the winches speed. FIG. 4 also shows the ducts 16 for fluid-dynamically connecting to each other the elements of the pneumatic drive system shown therein, in accordance with known in the art conventional methods existing for propagating flows of compressed air in a pneumatic circuit.

The invention claimed is:

1. A sailboat drive system, said sailboat having a motion transmission, said motion transmission being connected to a sail function means, characterised in that said sailboat drive system is a servo-pneumatic system, said servo-pneumatic system activating and/or deactivating said motion transmission to activate and/or deactivate said sail function means.

2. A sailboat drive system according to claim 1, comprising a compressed air reservoir, at least one pneumatic actuator, a pneumatic circuit for the flow of compressed air, at constant pressure, from said reservoir to said at least one pneumatic actuator, an on/off switch actuated by at least one crew member of the sailing boat to permit the flow of compressed air within said circuit, and a pneumatic valve activated by said switch, located between said compressed air reservoir and said at least one pneumatic actuator.

3. A sailboat drive system according to claim 2, wherein said on/off switch is operable by means of a quick and light push on the switch itself by a crew member of the sailing boat.

4. A sailboat drive system according to claim 2, wherein said on/off switch is operable by means of an electrical signal or by a signal sent via radio.

5. A sailboat drive system according to claim 2, wherein said on/off switch is active on a sliding wedge of said a pneumatic valve.

6. A sailboat drive system according to claim 2, wherein said at least one pneumatic actuator is a pneumatic cylinder.

7. A sailboat drive system according to claim 2, further comprising at least one pressure reducer located between said compressed air reservoir and said at least one pneumatic actuator, to reduce the pressure of the compressed air delivered by said reservoir.

8. A sailboat drive system according to claim 2, further comprising at least one distributor adapted to homogeneously and uniformly direct to several of said pneumatic actuators the compressed air delivered by said reservoir.

9. A sailboat drive system as in claim 1, said sailboat motion transmission comprising kinematic driving means, kinematic driven means and kinematic connecting means between said kinematic driving means and kinematic driven means, said kinematic connecting means being selectively deactivable to define a first operating configuration of said kinematic connection between said kinematic driving means and kinematic driven means to not allow any motion transmission from said kinematic driving means and kinematic driven means, and at least one second operating configuration of said kinematic connection between said kinematic driving means and kinematic driven means to allow a motion transmission from said kinematic driving means and kinematic driven means.

10. A sailboat motion transmission system according to claim 9, wherein said sailboat motion transmission system activates/deactivates a kinematic connection between at least one pedestal and at least one winch.

11. A sailboat motion transmission system according to claim 9, wherein said sailboat motion transmission system activates/deactivates a kinematic connection between two or more pedestals.

12. A sailboat motion transmission system according to claim 9, wherein said sailboat motion transmission system activates a winch in a kinematic connection to realize a new operating configuration corresponding to a specific rotation speed of the winch, by deactivating at the same time an earlier operating configuration corresponding to a different rotation speed.

13. A sailboat motion transmission system according to claim 9, wherein said sailboat motion transmission system activates a winch in a kinematic connection to realize a new operating configuration corresponding to a specific rotation speed of the winch, without deactivating at the same time an earlier operating configuration corresponding to a different rotation speed.

14. A sailboat motion transmission system according to claim 9, wherein said sailboat motion transmission system activates a winch speed multiplier.

15. A sailboat having at least one manually operated pedestal and a winch for adjusting a sail on said sailboat, the improvement comprising kinematic means for connecting and disconnecting said pedestal to said winch, a compressed air reservoir on said sailboat, a pneumatic cylinder for moving said kinematic means into one position to connect said pedestal to said winch to drive the same and into a second position to disconnect said pedestal from said winch, an on/off switch mounted on said sailboat operated by a crew member of said sailboat to control the flow of compressed air to said pneumatic cylinder from said reservoir, whereby said winch can be connected or disconnected from said pedestal by the crew member operating said on/off switch.

16. A sailboat as in claim 15, wherein said sailboat has two pedestals and a second kinematic means for connecting and disconnecting said second pedestal to one of said first pedestal and said winch, an on/off switch for said second pedestal and said second kinematic means, a second pneumatic cylinder for moving said second kinematic means into one position to connect said second pedestal to one of said first pedestal and said winch and a second position to disconnect said second pedestal from said one of said first pedestal and said winch.

* * * * *